US010640963B2

(12) United States Patent
Kim

(10) Patent No.: US 10,640,963 B2
(45) Date of Patent: May 5, 2020

(54) APPARATUS FOR REMOVING BAD ODOR FROM TOILET

(71) Applicant: SU TECHNOLOGY CO., LTD., Jeonju-si, Jeollabuk-do (KR)

(72) Inventor: Sang Gu Kim, Jeonju-si (KR)

(73) Assignee: SU TECHNOLOGY CO., LTD., Jeonju-si, Jeollabuk-Do (KR)

( * ) Notice: Subject to any disclaimer, the term of this patent is extended or adjusted under 35 U.S.C. 154(b) by 27 days.

(21) Appl. No.: 15/881,368

(22) Filed: Jan. 26, 2018

(65) Prior Publication Data

US 2018/0148916 A1 May 31, 2018

Related U.S. Application Data

(63) Continuation-in-part of application No. PCT/KR2016/008444, filed on Aug. 1, 2016.

(30) Foreign Application Priority Data

Jul. 30, 2015 (KR) ..... 10-2015-0108326
Dec. 4, 2015 (KR) ..... 10-2015-0172029
Nov. 28, 2017 (KR) ..... 10-2017-0159866

(51) Int. Cl.
*E03D 9/05* (2006.01)
*E03D 1/33* (2006.01)
*A47K 13/30* (2006.01)

(52) U.S. Cl.
CPC ..... *E03D 9/05* (2013.01); *A47K 13/307* (2013.01); *E03D 1/33* (2013.01)

(58) Field of Classification Search
CPC ..... E03D 9/05; E03D 1/33; A47K 13/307
USPC ..... 4/209 R
See application file for complete search history.

(56) References Cited

U.S. PATENT DOCUMENTS 1,303,974 A * 5/1919 Shadall; C ..... E03D 9/05 4/215
2007/0056083 A1* 3/2007 Blouet ..... E03D 9/05 4/213
2013/0086736 A1* 4/2013 Larouche ..... E03D 9/052 4/348
2015/0354189 A1* 12/2015 Kim ..... A47K 13/307 4/349

FOREIGN PATENT DOCUMENTS

JP 08-277563 A 10/1996
KR 10-2004-0103432 A 12/2004
KR 20-0393220 Y1 8/2005
KR 10-0568252 B1 4/2006
(Continued)

*Primary Examiner* — Huyen D Le
(74) *Attorney, Agent, or Firm* — Novick, Kim & Lee, PLLC; Jae Youn Kim

(57) ABSTRACT

Provided is an apparatus for removing a bad odor from a toilet. The apparatus includes: a toilet body; and a water storing means for storing water to supply water to the toilet body according to an operation of a sensing means or a user command means including a lever, wherein the water storing means includes: a suction means which is directly or indirectly connected to the toilet body and suctions the air including an odor of the toilet body while the water is not supplied to the toilet body; and a discharging means for discharging the air suctioned by the suction means when the air is immersed in the water.

12 Claims, 12 Drawing Sheets

(56) References Cited

FOREIGN PATENT DOCUMENTS

| | | | |
|---|---|---|---|
| KR | 10-0798661 | B1 | 1/2008 |
| KR | 10-2010-0049464 | A | 5/2010 |
| KR | 10-2010-0106892 | A | 10/2010 |
| KR | 20-0451717 | Y1 | 1/2011 |
| KR | 10-1058923 | B1 | 8/2011 |
| KR | 10-2013-0002392 | A | 1/2013 |
| KR | 10-1382693 | B1 | 4/2014 |
| KR | 10-1409515 | B1 | 6/2014 |
| KR | 10-1495133 | B1 | 2/2015 |
| KR | 10-1502302 | B1 | 3/2015 |

* cited by examiner

APPARATUS FOR REMOVING BAD ODOR FROM TOILET

This application is a Continuation-in-Part Application of PCT/KR2016/008444, filed Aug. 1, 2016, which claims priority to KR 10-2015-0108326, filed Jul. 30, 2015 and KR 10-2015-0172029, filed Dec. 4, 2015, and further this application claims priority to KR 10-2017-0159866, filed Nov. 28, 2017, disclosures of which are all incorporated herein by reference.

TECHNICAL FIELD

The present invention relates to an apparatus for removing a bad odor from a toilet, and more particularly, to an apparatus for removing a bad odor from a toilet which is for a direct water-type toilet and is improved to protect the human body from bacteria and achieve a toilet with a pleasant environment by suctioning and removing a bad odor and bacteria occurring when using the direct water-type toilet in which a water pressure of tap water is used.

BACKGROUND ART

In general, a toilet (referring to a western style toilet) refers to, but not limited to, a sitting type western toilet on which a person sits and relieves himself/herself and includes other type of toilets using water.

Such a toilet generally includes: a seat on which a user sits to relieve herself/himself; a toilet body for discharging excrement to a septic tank together with supplied water; a water tank which is provided on one upper end portion of the toilet body and supplies, stores, and discharges the supplied water to thereby discharge excrement to the septic tank.

Such a toilet has a structure, in which urine and feces discharged from the eliminatory organ of a user when the user relieves herself/himself are temporarily stored and discharged, is therefore liable to severely stink simultaneously with defecation, is prone to allow various pathogenic bacteria, such as well-known *salmonella, Escherichia coli, shigella, globalrium* bacteria, and the like to grow. In particular, it has been announced that in a region contacting the user's body, *Staphylococcus aureus, Pseudomonas aeruginosa, Staphylococcus aureus, Streptococcus pneumoniae*, and the like grow.

However, these pathogens may also be harmful according to a user's health condition. Diseases caused by these pathogens may be a variety of skin diseases, respiratory diseases, etc., and severe discomfort is caused by these pathogens when the user uses a toilet.

In this regard, multiple patent documents, such as Korean Patent Publication No. 2004-0103432, Korean Patent Publication No. 2010-0049464, Korean Patent Publication No. 2010-0106892, Korean Patent No. 0568252, and Korean Utility Model No. 0393220, have disclosed techniques for removing an odor occurring when using the toilet.

However, the disclosed techniques mostly adopt methods using chemicals, ultraviolet processing, ultrasonic cleaning, or the like, as a means for deodorizing to remove an odor or pathogen, and for sterilization, pasteurization, and antibacterial process. Thus, the disclosed techniques have a drawback of having a complicated structure, high manufacturing costs, while having an unsatisfactory effect.

Therefore, most users prevent pathogens from spreading into the entire restroom by operating a lever while a lid is put on the toilet bowl after using the toilet. This is because various reports and mass media reported that the spread of the pathogen was reduced by more than two times when the lid was put on the toilet bowl compared to that when the lid was not put on the toilet bowl.

However, since there is inconvenience to put on the toilet bowl lid every time, most users do not carefully put the lid on the toilet bowl due to the inconvenience or the like. In addition, although an action of putting the lid on the toilet bowl should be made on purpose, it is easy to forget the action, and thus, it is not easy in fact to make the action of putting the lid on the toilet bowl.

In order to solve this, the present applicant had filed multiple patents, such as Korean Patent No. 1502302, Korean Patent No. 1382693, and Korean Patent No. 1409515 based on the results of years of research.

Meanwhile, although the aforementioned toilets use a method of processing excrement by cause water to flow and be stored in a water tank while being equipped with a water tank, the method consumes too much water, water pressure used in the method is too low, and too much installation space is required. Therefore, unlike the above method, a direct water-type toilet has also been widespread in which the water tank is not equipped with a water tank, and the water supply pipe is directly connected without a water tank, so that water can be supplied to only in case of necessity.

For example, in a direct water-type toilet, as illustrated in FIG. 1, a water supply pipe 20 for supplying water to a toilet body 100 is installed in the rear side of the toilet body 100, and a direct-water pipe 40 which is a tap water pipe is directly connected to the water supply pipe 20 via a valve body 300. When a user pushes a lever 32 provided to the valve body 300 after using the toilet, the water pressure applied to the tap water pipe is directly applied to supply the water and thereby discharge excrement.

Such a structure, as described above, is simple, does not occupy much installation space, and has a merit of having excellent discharge capability due to a high water pressure.

However, such a direct water-type toilet has a difficulty in being provided with a device for removing an odor.

This is because in the case of a water tank type, a method of removing an odor by using a water tank can be adopted, but in the case of the direct-water type, there is no water tank, and thus, at most a detachable-type deodorization device disclosed in Korean Patent No. 1058923 or Japanese Patent Publication No. 1996-277563 can only be adopted.

However, since the disclosed detachable type has a structure which is attached to and then detached from a toilet body, it is very inconvenient to sit thereon, the outer appearance is not satisfactory, and in particular, since men urinates while standing, urine scattered during urination stains the toilet, and thus, the detachable type has a drawback of being sanitarily unclean.

In addition, recently, water-saving toilets have been disclosed according to governmental policies, the water-saving toilets are the types designed such that water for cleaning the inside of the toilet boy made of porcelain is supplied through a path different from that of water for discharging excrement so as to prevent waste of water.

That is, a general toilet is configured such that when the toilet is flushed with water, while the water having filled a water tank is poured down into a toilet body, one portion of the water is poured down together through a plurality of washing water holes formed in an inner peripheral surface of the toilet body to cause excrement to flow to a toilet drain port, and the other portion washes the inner wall surface of the toilet body.

Therefore, in this structure, the water tank should be designed considering even washing water, and thus, waste of water is excessive and contributes to accelerate water shortage phenomenon which is getting worse. Thus, the water-saving toilet was disclosed to solve this problem.

However, while many techniques for removing an odor in general-type toilets, the technique of removing an odor in the water-saving toilets is not yet satisfactory, and thus, an improvement on this is being demanded.

DISCLOSURE OF THE INVENTION

Technical Problem

The present invention has been devised to address the aforementioned limitations, and the purpose of the present invention is to provide an apparatus for removing a bad odor from a direct water-type toilet, the apparatus having a simple structure to be easily installed, conveniently used, and manufactured at a low cost, and being configured to have excellent effect of removing an odor and pathogen, thereby being capable of protecting the human body and maintaining a pleasant toilet use environment.

Another purpose of the present invention is to check whether a toilet is in use is assured by using a sensor etc., and discharge air including an odor through a discharging means, which is provided in a state in which the air including an odor is suctioned and immersed in a water storing means, according to a control of a control unit.

Still another purpose of the present invention is to provide an apparatus for removing a bad odor from a two way-type toilet, the apparatus being improved such that an odor occurring in a water-saving two way-type toilet after a user uses the toilet can be quickly suctioned and removed.

Technical Solution

An apparatus for removing an odor according to the present invention includes: a water storing means, in which: a water supply pipe of a toilet is provided to pass therethrough; an upper end or an upper portion of the water supply pipe is provided to be at a predetermined height from the bottom surface thereof; and a tap water pipe connected to a valve body is connected to one side thereof, and which includes a water tank comprising an air hole formed in an upper portion thereof;

a float connected to an upper portion of the water supply pipe and configured to open/close the water supply pipe and close the air hole by contacting the air hole when the water supply pipe is opened; and an air suctioning/discharging means installed inside the water tank, and including a suction port connected to the water supply pipe and a discharge port configured to discharge odor-containing air supplied from the suction port, wherein the discharge port is disposed at a position lower than the predetermined height at which the water supply pipe is disposed, discharges air while being immersed in water, and is operated according to operations of a detecting means and a control unit.

In addition, the present invention is characterized by including: a water storing means, in which: a water supply pipe of a toilet is provided to pass therethrough; an upper end or an upper portion of the water supply pipe is provided to be at a predetermined height from the bottom surface thereof; and a tap water pipe connected to a valve body is connected to one side thereof, and which includes a water tank comprising an air hole formed in an upper portion thereof; a float configured to open/close the water supply pipe;

a first water pressure valve provided on a lower portion or under the air hole of the water tank and configured to open/close the air hole formed in the water tank according to a pressure of water supplied through the valve body; and an aspirator which is an air suctioning/discharging means connected to the water supply pipe, wherein the aspirator includes a discharge port configured to discharge odor-containing air to the water storing tank, wherein the odor-containing air suctioned from a toilet body through the water supply pipe is discharged through the discharge port to the water storing tank filled with water according to a position of the float.

Thus, according to the present invention, an excellent effect of removing an odor is also exhibited particularly in a direct water-type toilet, so that growth of bacteria and odors is prevented, pathogens are prevented from being spread to the entire rest room to thereby provides a more pleasant toilet use environment, and the apparatus for removing an odor has simple structure and is easy and convenient to install and may thereby be manufactured at a low cost.

In addition, an effect of quickly suctioning and removing an odor occurring in a water-saving two-way type toilet after a user uses the toilet may be achieved.

In addition, the technical idea of the present invention may also be applied to various methods.

MODE FOR CARRYING OUT THE INVENTION

Figure 1:
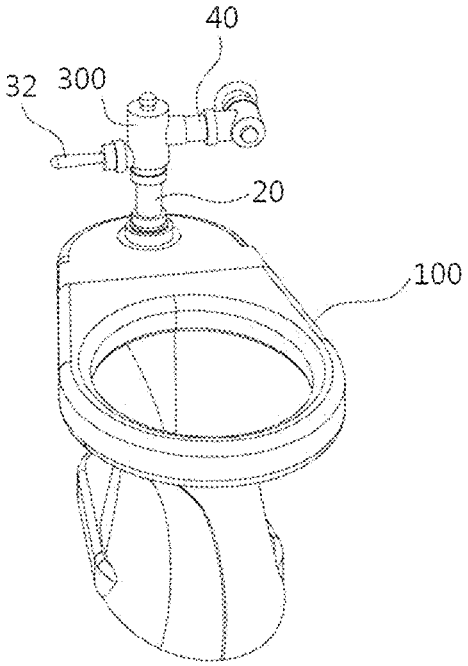
FIG. 1 is an exemplary view of a conventional direct water-type toilet.

Hereinafter exemplary embodiments of the present invention will be described in detail with reference to the accompanying drawings.

First, when reference numerals are assigned to the components in each of the drawings, it should be noted that the same components, although illustrated in different drawings, are allowed to have the same reference numerals if possible. Further, when the embodiments of the present invention are described, regarding substantially the same matters, the detailed description thereof will be omitted.

Further, when a component is described as "connected to", "coupled to" or "contacting" another component, the component may be directly connected or contact the another component, but a case in which a still another component is "connected", "coupled" or "contacts" between each of the components should also be understood as the same technical idea.

Further, when a component is described as being provided, formed or configured, the description should be interpreted as having substantially the same meaning, unless there is a specific definition thereof.

Also, in the present invention, the meaning of "comprise" is an open-type meaning that "may further comprise other features".

In describing the present invention, an expression, such as "upper end", "upper end portion", "lower end", or "lower end portion", can be interpreted to denote not only an end portion of a configuration but also a portion of the configuration (upper part, lower part, or the like), and this would be interpreted through the entire contents of the present invention. That is, the expressions should be interpreted as terms for denoting not only an end portion of a component but also portions of the corresponding position in the component.

The float referred to in the description of the present invention is one example of a toilet water level adjusting means, and also when replaced by another means, corresponds to the technical idea of the present invention.

Figure 2:
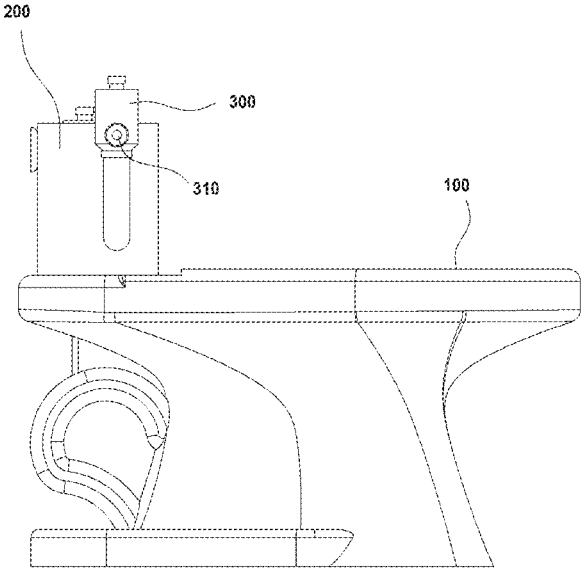
FIG. 2 is an exemplary side view of a direct water-type toilet provided with an odor removing apparatus according to the present invention.
Figure 3:
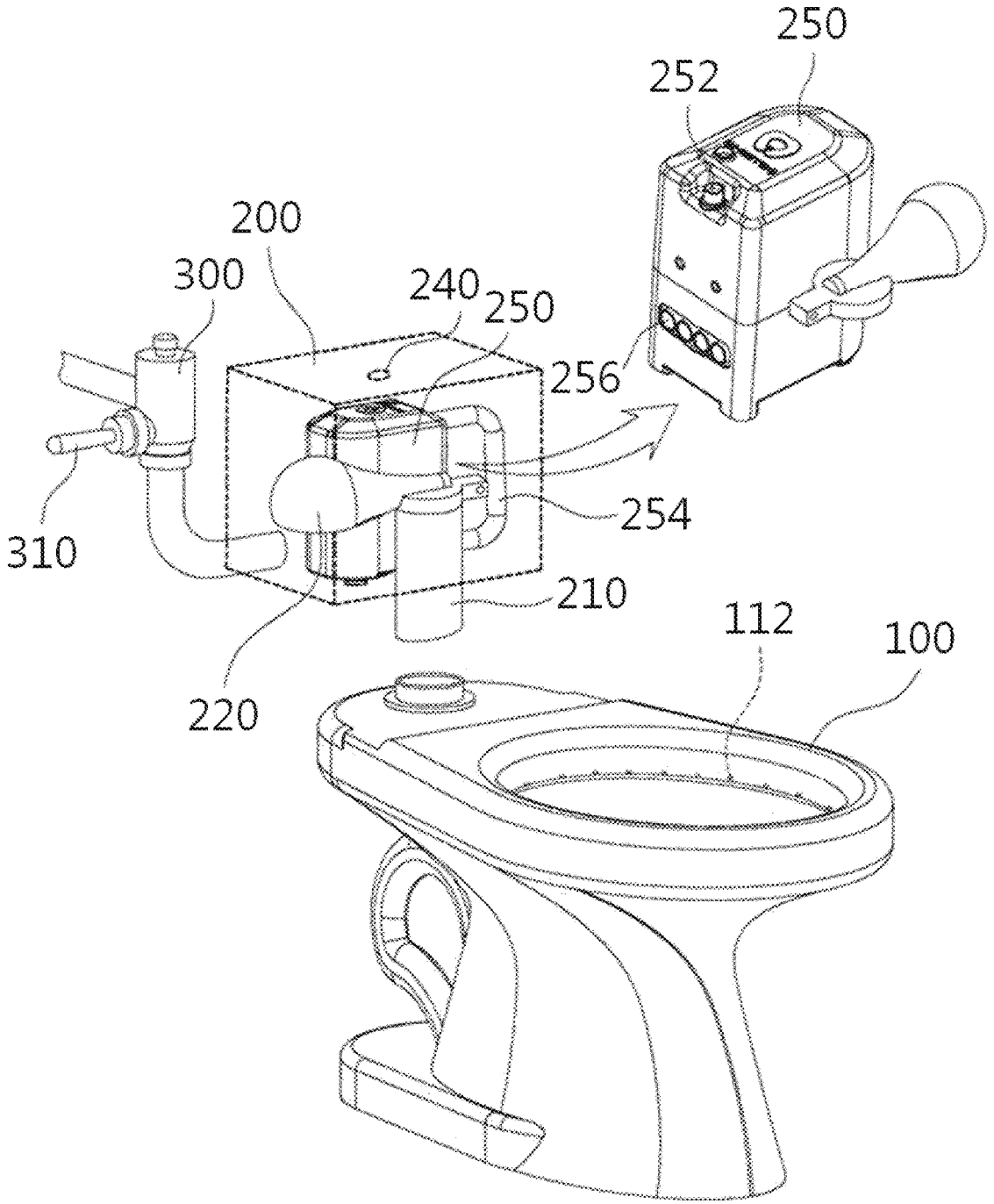
FIG. 3 is an exemplary partial exploded view illustrating a configuration and an installation example of an odor removing apparatus according to the present invention.

As illustrated in FIGS. 2 and 3, an apparatus for removing a bad odor from a direct water-type toilet according to a preferred embodiment of the present invention includes a toilet body 100.

The toilet body 100 has a commonly known structure as it is and is configured to store a predetermined amount of water and then discharge the remaining excrement to a drain after a user uses the toilet.

At this point, the present invention is provided with a small water tank 200 as an example of a water storing means.

The small water tank 200 differs from existing water tanks in having a relatively much smaller size than the existing water tanks and uses direct water.

Therefore, the water tank has only to be understood as having almost no restriction in installing space, and as a type including a deodorization module for suctioning an odor while water passes thereby. Furthermore, in FIG. 3, since an air hole 240 is blocked by an action of a float 220 which is an example of a toilet water level adjusting means, the method is a type in which water pressure of tap water is used, and thus, the present invention may also be said to be a direct water type in which water pressure of tap water is used.

However, the present invention is obviously a novel invention in that the above-mentioned direct water-type is not a type in which portions of two components are simply merged, but a type improved such that direct water can be used. This will be described later.

That is, a valve body 300, which is a kind of means connected to a direct water pipe (tap water pipe) to control the opening/closing of water, is connected by piping onto one side surface of the small water tank 200 which is an example of water storing means, and a lever 310 which is a kind of user command inputting means is installed on the valve body 300. In the present invention, the lever may also be replaced by a push-type device or other-type devices and the lever is an example of user command input means for opening/closing a valve. In addition, the valve body is just an example of a control means for opening/closing water and may be replaced by other means, and thus, the scope of the present invention is not limited to the above configuration.

Accordingly, when the lever 310 is pushed down, water is supplied into the small water tank 200, while the water pressure of tap water is applied as it is, and is discharged to the toilet body through a water supply pipe. That is, since excrement is discharged due to the water pressure, the embodiment of the present invention also corresponds to a direct-water type.

In addition, the water supply pipe 210 is disposed on one side of the small water tank 200 in a lower or lower end surface thereof to pass through the small water tank, and a lower end portion (lower end) on one side of the water supply pipe 210 is connected to the toilet body 100.

At this point, on the other side of the water supply pipe 210, an upper portion or an upper end portion (upper end) thereof should be maintained at a state of being spaced a predetermined height apart from the bottom surface of the small water tank 200.

Here, the predetermined height has only to be a degree such that a discharge port 256 is immersed (dipped) in water.

This is an idea completely different from existing water tank-type toilet, and the present invention has a structure in which the bottom of the small water tank 200 should be filled with water at a certain height. Since in conventional water tank-type toilet, a sufficient water pressure may be obtained if water should be completely or substantially completely discharged rather than remain in the bottom of the water tank, the conventional water tank-type toilet has a structure in which the upper end of the water supply pipe should be disposed to correspond to the bottom of the water tank. On the contrary, in the present invention, water is discharged due to the water pressure of tap water, and the inner structure of the water tank is modified such that the inlet of the water supply pipe is positioned at a predetermined height to allow water to be present under the inlet. Thus, the water may be used to dissolve an odor supplied through the discharge port 256 which is an example of a discharging means provided to an aspirator which is an example of sir suctioning/discharging means.

In addition, the float 220 for opening/closing the water supply pipe 210 is installed on an upper end of the water supply pipe 210.

In addition, the air hole 240 through which external air may be introduced to mitigate an inner pressure of the small water tank 200 is formed on the ceiling surface of the small water tank 200.

Meanwhile, inside the small water tank 200, an aspirator 250 which is an example of the air suctioning/discharging means is installed.

The aspirator 250 is a general collective name of units which can suction a kind of air, and the aspirator 250 suctions an odor remaining inside the toilet body 100 through the water supply pipe 210, guides the air to the small water tank 200 through a connection pipe 254, which is an example of connection means, and through a plurality of discharge ports 256, and allows the air to be dissolved in the water stored at a predetermined height from the bottom of the small water tank 200.

Accordingly, in the aspirator unit, a portion of internal air in which an odor is dissolved and purified is allowed to be discharged to the outside in a purified state through the air hole 240.

Therefore, the air hole 240 is a very important configuration. The inner pressure of the small water tank 200 varies according to the operation of the aspirator 250 which is an air suctioning/discharging means (for example, when the inner pressure increases, a gas mixture containing an odor is not suctioned), and the varying inner pressure may maintain an equilibrium while being naturally discharged through the air hole 240.

In addition, a hole is formed in one-side portion or some portion of the outer circumference of the water supply pipe 210, and the suctioning inlet 252 of the aspirator 250 is connected through a connection pipe 254 which is a connection medium.

In addition, a plurality of discharge ports 256 are formed in a lower side surface, including a lower end, of the aspirator 250 to discharge the suctioned odor to the water tank 200, and the discharge ports 256 should be in a state of being immersed in water.

The reason why this is possible is because the upper end of the water supply pipe 210 protrudes a certain height from the bottom surface of the small water tank 200, and therefore, the small water tank is always in a state in which the water is always filled up to a height equal to or lower than the certain height.

In addition, in the operation of the aspirator 250, as an example for the operation, a temperature sensor for detecting the body temperature of a person, a proximity sensor for detecting an approach of a person, or a sensor for detecting an odor (for example, a kind of odor sensor for detecting a specific odor such that the sensor detects the odor when a component content emitting the specific odor reaches a certain degree) is installed on a portion of the toilet body 100, and the aspirator 250 may be configured to be turned on/off according to the control of the control part (not shown) by using the detected signal of the sensor.

As another example, when the lever 310 is operated, or also when the toilet is flushed with water after being used, a circuit design can be made, of course, such that the float 220 operates for a predetermined time after being closed. Assuring the closure of the float may be from another sensor, or may be set such that when a predetermined time elapses after the float is opened, the float is closed.

The present invention including such a configuration has an operation relationship as the following.

When a user sits on the toilet body 100 to relieve herself/himself and starts to relieve, the aspirator 250 is operated. That is, the aspirator 250 can be operated by one or more operations of any one of more the sensors and according to a control of the control unit.

Then, an odor is suctioned through a water supply port or a washing water holes 112 which are formed in the inner wall surface of the toilet body 100, and the suctioned odor is collected into the water supply pipe 210, and is then discharged into the water stored in the small water tank 200 through the discharge ports 256 via the aspirator 250 through the connection pipe 254.

Accordingly, the odor is discharged into the water in a bubble shape, and is therefore instantaneously dissolved, and an increased pressure generated in this process inside the small water tank 200 is released through the air hole 240.

Subsequently, when the relieving is completed and the toilet is flushed with water by pushing down the lever 310, direct water from a tap water pipe is instantaneously introduced into the small water tank 200, and the float 220 is raised simultaneously. When the water level exceeds the upper end of the water supply pipe 210, the water supply pipe 210 is opened, and excrement is discharged to a drain tank by discharge water while water is rapidly discharged through the water supply pipe.

In this process, if the water level rises too high, the upper portion or the upper end portion of the rising float 220 closes the air hole 240, while contacting the ceiling surface of the small water tank 200, thereby seals the air hole 240 such that water may not be scattered to the outside through the air hole 240, and thus the toilet can be safely used. In this case, water may be more strongly discharged through the water supply pipe.

In addition, when the toilet is flushed with water, the operation of the aspirator 250 is in a state of being stopped or being performed. That is, the operation may be turned on/off according to the preset information, the sensing information, or the information which is about a user who is the person using the toilet and is manually input.

As such, a direct-water type is also implemented in a hybrid type by incorporating the small water tank 200, and thus, may be expected to be very useful in sanitary and health aspects because an odor can be effectively and efficiently suctioned and removed.

Figure 4:
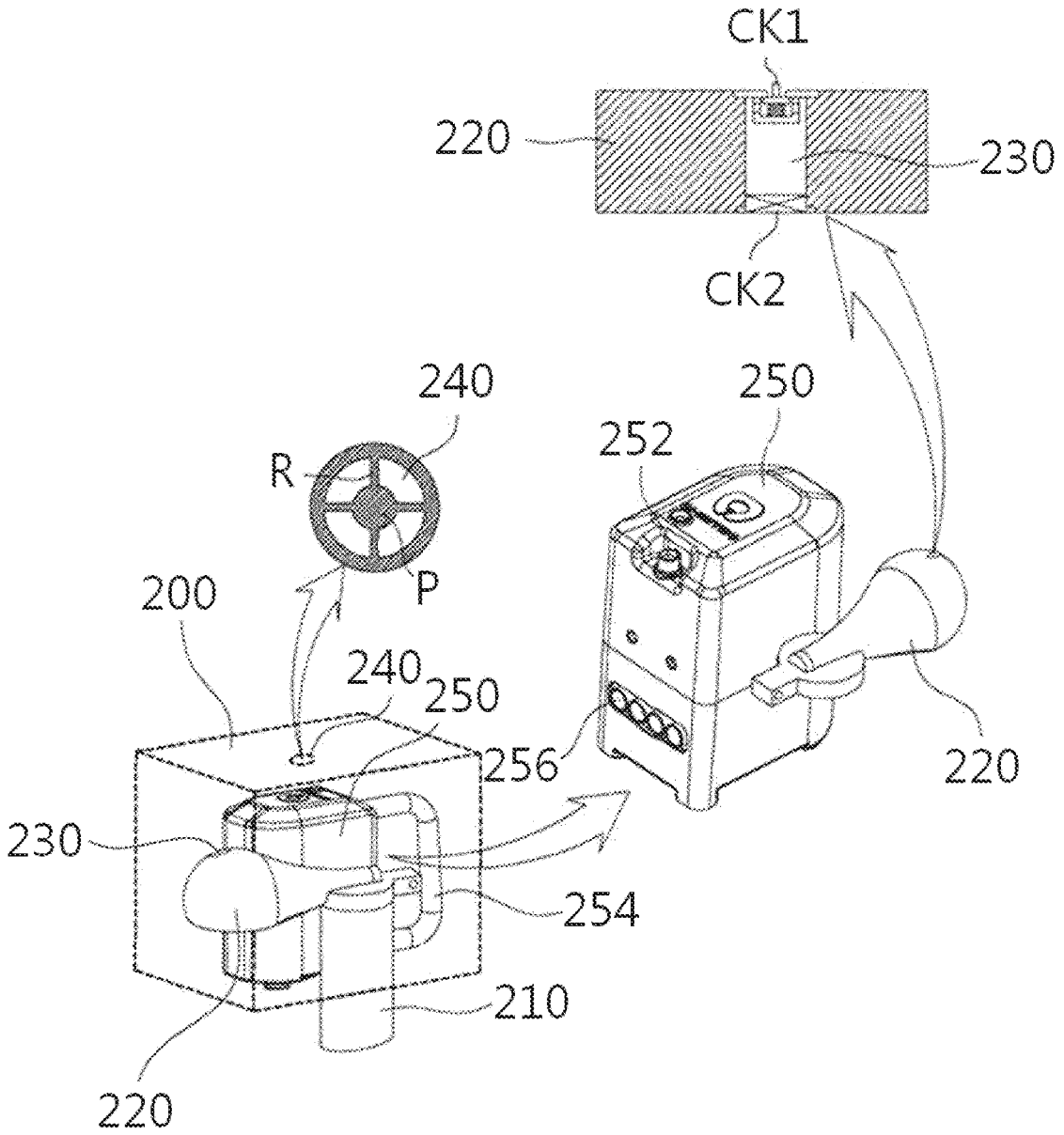
FIGS. 4 to 7 are exemplary views illustrating another example of an odor removing apparatus according to the present invention.

Meanwhile, another preferred example according to the present invention may be modified as illustrated in FIG. 4.

According to FIG. 4, a float 220 may be rotatably and hingedly fixed through a separate bracket extending from a water supply pipe 210 as that in existing arts, or may also be rotatably provided such that a hinge shaft is fixed onto both inner walls of a small water tank 200.

In addition, a vertically penetrating air vent hole 230 is formed on an end portion or the tip (the end opposite the hinge shaft) of the float 220.

The air vent hole 230 is configured to be opened when the float 220 receives a large buoyant force, and closed when the float 220 receives a small buoyant force, and to this end, a push-type valve CK1 may be installed on the upper end of the air vent hole 230.

Of course, for a stable operation, a known valve CK2 may further be installed also on the lower end of the air vent hole 230, but preferably, only the push-type valve CK1 may be installed.

Figure 5:
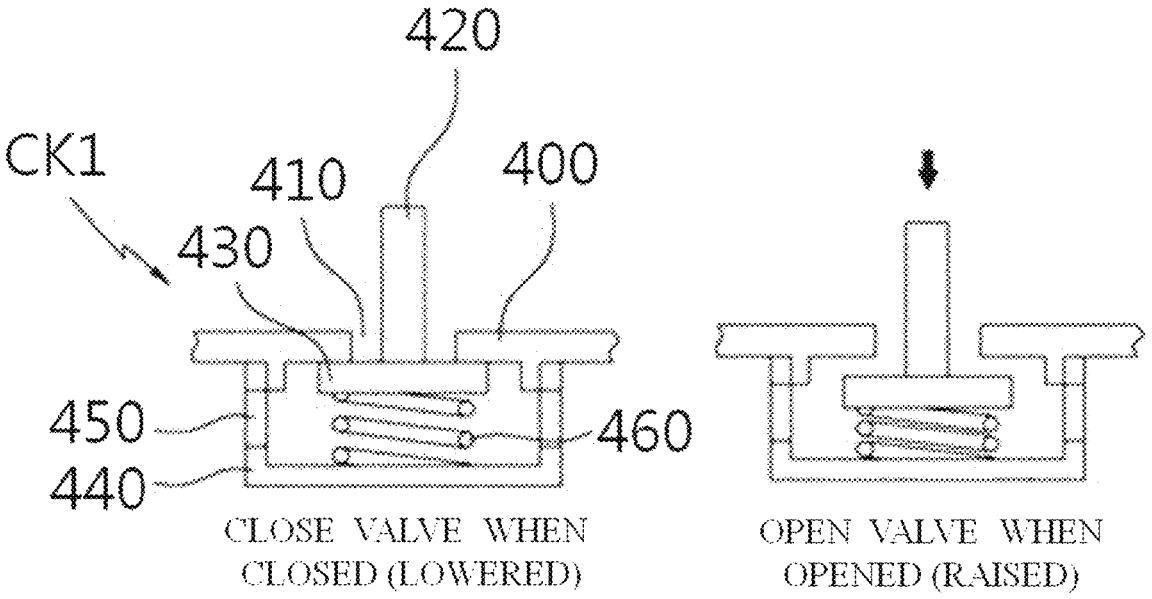

At this point, the push-type valve CK1, as illustrated in FIG. 5, is configured to include: a fixed base 400 inserted into and fixed to the upper end of the air vent hole 230; a flow hole 410 formed to pass through the fixed base 400; a movable rod 420 inserted into the flow hole 410; a sealing plate 430 fixed to the lower end of the movable rod 420; a cylindrical cap 440 detachably fixed to the fixed base 400; an air outlet hole 450 drilled and formed in a portion of the circumference of the cap 440; and an elastic spring 460 interposed between the inner bottom surface of the cap 440 and the lower surface of the sealing plate 430.

In addition, for the operation of the push-type valve CK1, the air hole 240 has, as illustrated in FIG. 4, the air hole 240 has a structure in which a contact plate P supported by a plurality of ribs R on the center of a circle is formed.

Therefore, the push-type valve CK1 is opened while the upper end of the movable rod 420 contacts and pressed by the contact plate P, and at this point, the air supplied through the air hole 240 is introduced into the air vent hole 230 via the flow hole 410 and the air outlet hole 450.

Accordingly, when the float 220 is raised and contacts the ceiling surface or the small water tank 200, more specifically, the contact plate P and is pressed, the air vent hole 230 is opened, and then, external air outside the small water tank 200 is introduced and supplied under the float 220. Therefore, the closing speed of the float 220 is slowed down. In other words, the closure of the float 220 is delayed.

This is for the purpose of preventing a phenomenon of insufficient discharge of excrement which may occur because when a lever 310 of a valve body 300 is closed too early, or a change in water pressure occurs, the water pressure when the float 220 is raised drops below the water pressure when water is initially supplied and the float 220 is thereby instantaneously lowered and closed, and in that case, water supply is stopped before the excrement is completely discharged. This case is referred to as the case when a small buoyant force is applied, and the case in which the float 220 is strongly raised when water is initially supplied is referred to as, for example, the case in which a large buoyant force is applied.

In addition, when a valve CK2 is further installed, the valve CK2 is opened only downward and always closed in the reverse direction. Therefore, when the air vent hole 230 coincides with the air hole 240 while contacting the ceiling surface of the small water tank 200 which is one of water storing means, external air is introduced while the push-type valve CK1 is opened, and when the contact state is released, the air vent hole 230 is closed by the elasticity of the spring of the push-type valve CK1 per se, and at this point, a reverse flow of the air supplied into the small water tank 200 is prevented.

Of course, as described above, the push-type valve CK1 and the valve CK2 may not be provided in the air vent hole 230, but are further provided. Thus, in case of an unexpected accident, that is, when an excessive water pressure is applied due to a failure of the valve body 300, these valves are further favorably provided to completely prevent even the probability that the water inside the small water tank 200 is ejected outside the water tank through the air vent hole 230 and the air hole 240.

Such a structure is an exemplarily provided, but may be modified in any degree within the technical idea of the present invention.

Figure 6:
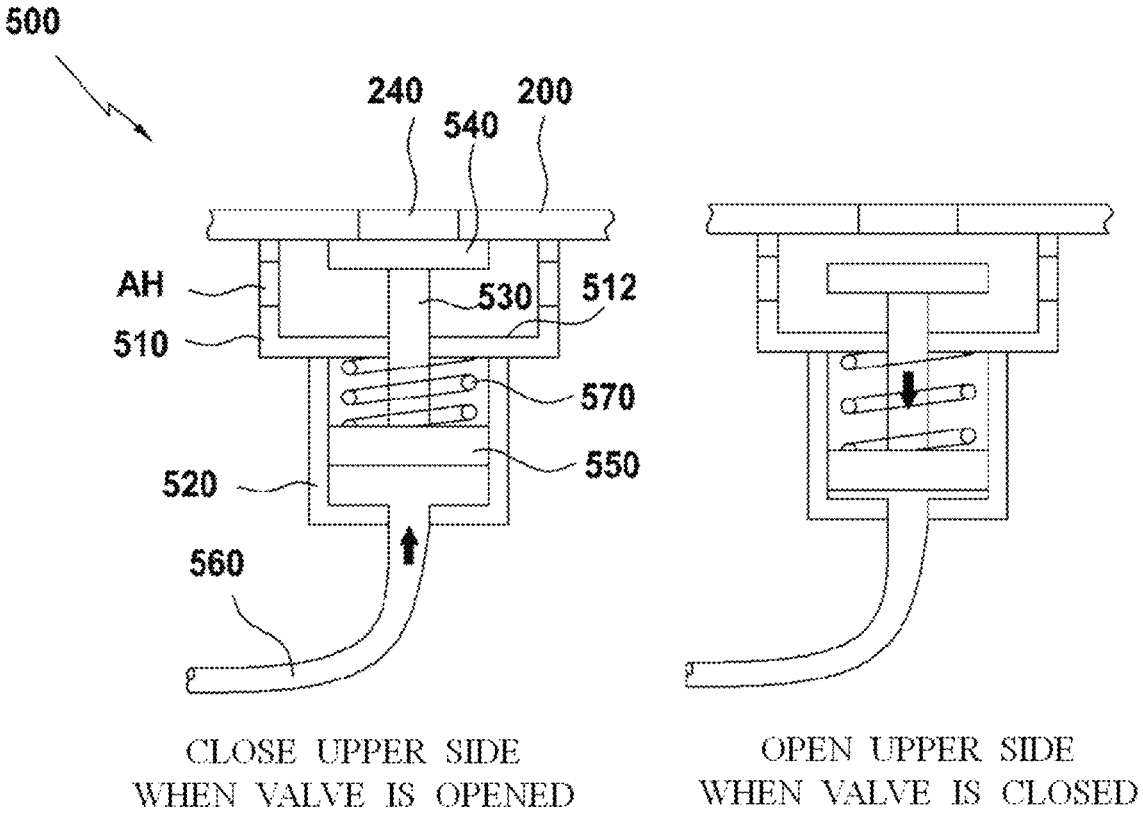

Meanwhile, another modified example, as illustrated in FIG. 6, may be configured such that while a float 220 without an air vent hole 230 is used, a first water pressure valve 500 is installed, instead of the aforementioned valve CK1, under an air hole 240 of a small water tank 200 and the first water pressure valve 500 directly opens/closes the air hole 240.

Here, the first water pressure valve 500 is configured to include: a cylindrical fixed housing 510 fixed to the ceiling surface of the small water tank 200; a cylindrical water storing housing 520 which integrally extends on the lower end surface of the fixed housing 510 and is separated from the fixed housing 510 by a bottom plate 512 as a border therebetween; an opening/closing rod 530 installed to pass through the bottom plate 512; an opening/closing plate 540 fixed to the upper end of the opening/closing rod 530 and disposed to open/close the air hole 240; a water pressure plate 550 fixed to the lower end of the opening/closing rod 530 and disposed inside the water storing housing 520; a water pressure guiding hose 560 which is connected to pass through the bottom surface the water storing housing 520 so as to communicate with the water storing housing 520, extends to be exposed toward the inside of a valve pipe of the valve body 300 (refer to FIG. 3), and is opened/closed by means of the pressure plate 550; and an opening/closing spring 570 interposed between the water pressure plate 550 and the bottom plate 512.

Accordingly, when water is supplied from the valve body 300 by pressing a lever 310, a portion of the water moves along the water pressure guiding hose 560 and since the water pressure at this time is sufficient to push the water pressure plate 550 upward, the water pressure plate 550 rises while compressing the opening/closing spring 570.

Then, while the opening/closing rod 530 rises and the opening/closing plate 540 is brought into close contact with the ceiling surface of the small water tank 200, the air hole 240 is closed so as to prevent water to leak when the water is excessively supplied.

In addition, a method of fixing the fixed housing 510 to the ceiling surface of the small water tank 200, although not shown specifically, there may be various methods, such as, a method in which a protrusion part is formed on the ceiling surface as described above and the fixed housing 510 is fastened to the protrusion part with a screw, or a method in which the fixed housing 510 is fixed by means of a separate bracket. Therefore, the method is not particularly limited here, and the method of fixing the water storing housing 520 to the fixed housing 510 is the same.

In addition, a non-described reference symbol "AH" is an air flow hole which is a passage for releasing the internal pressure of the small water tank 200 when the air hole 240 is opened.

In addition, other configurations such as an aspirator 250 are the same as those described above.

Figure 7:
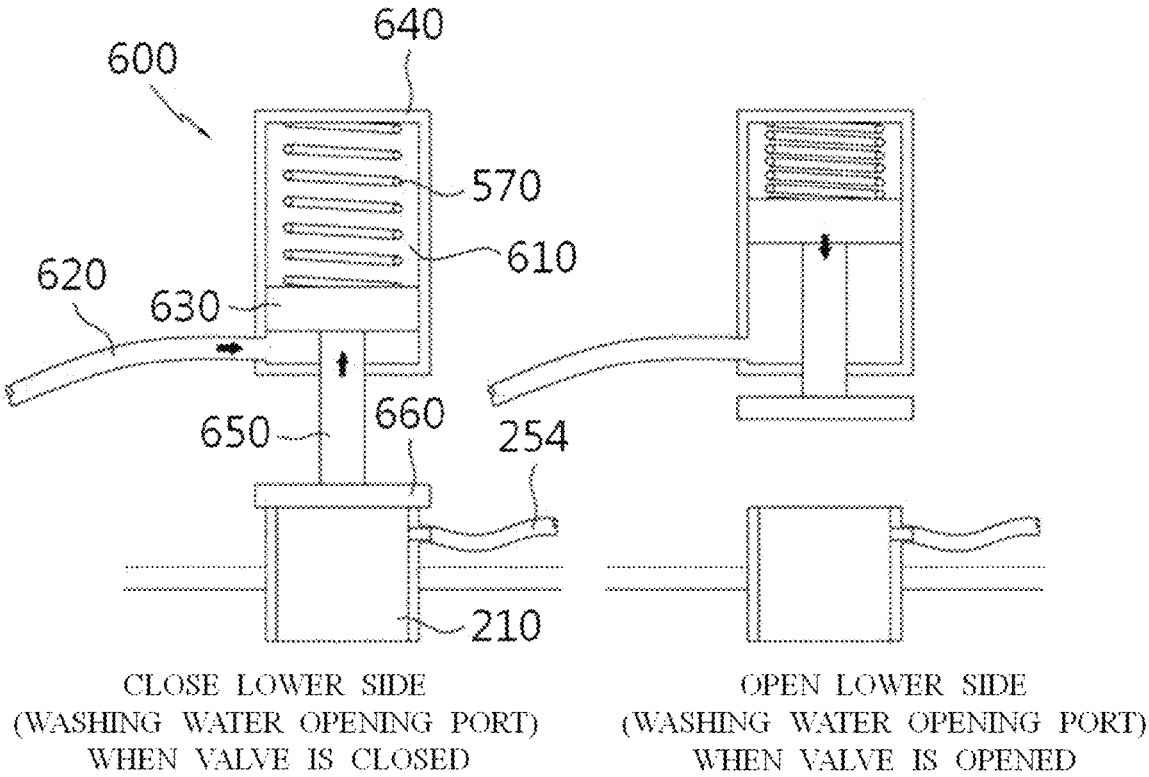

Meanwhile, as illustrated in FIG. 7, the present invention may be modified into a method in which a water supply pipe 210 is directly opened/closed by using a second water pressure valve 600 without using a float 220.

The second water pressure valve 600 is configured to include: a tubular body 610 which is fixedly installed inside a small water tank 200 by using a separate bracket and has closed upper and lower surfaces; a water pressure generating hose 620 which is connected to pass through one side of an outer circumferential surface on a lower end portion of the tubular body 610 and extends to be exposed to the inside of a valve pipe of a valve body 300 (refer to FIG. 3); a movable plate 630 installed inside the tubular body 610 at a higher position than a position connected with the water generating hose 620; a movable spring 640 interposed between the movable plate 630 and the ceiling surface of the tubular body 610; a movable rod 650 fixed to the lower end of the movable plate 630; and a water supply pipe opening/closing plate 660 fixed to the lower end of the movable rod 650 to open/close the water supply pipe 210.

Of course, in this case, it is preferable that the opening/closing of an air hole 240 may be performed by using the first water pressure valve 500 described above.

Accordingly, when water is supplied from the valve body 300 by pressing a lever 310, a portion of the water moves along the water pressure guiding hose 620 and since the water pressure at this time is sufficient to push the water pressure plate 630 upward, the movable plate 630 rises while compressing the movable spring 640.

Then, since the water supply opening/closing plate 660 is raised while the movable rod 650 rises, the water supply pipe is consequently opened, and at this point, water is supplied through the water supply pipe 210 and discharge excrement to a drain tank.

Conversely, when the lever 310 is released, since the water supply is cut and water pressure is dropped. Therefore, the water supply pipe 210 is closed by the water supply pipe opening/closing plate 660 by an elastic return force of the movable spring 640.

In addition, it is effective that an odor removing operation is performed while the water supply pipe 210 is closed.

In addition, a portion of the outer circumferential surface of the water supply pipe 210 and a suction port 252 of an aspirator 250 is connected by means of a connection pipe 254.

As such, a direct water-type odor removing apparatus according to the present invention may be modified into various shapes.

Figure 8:
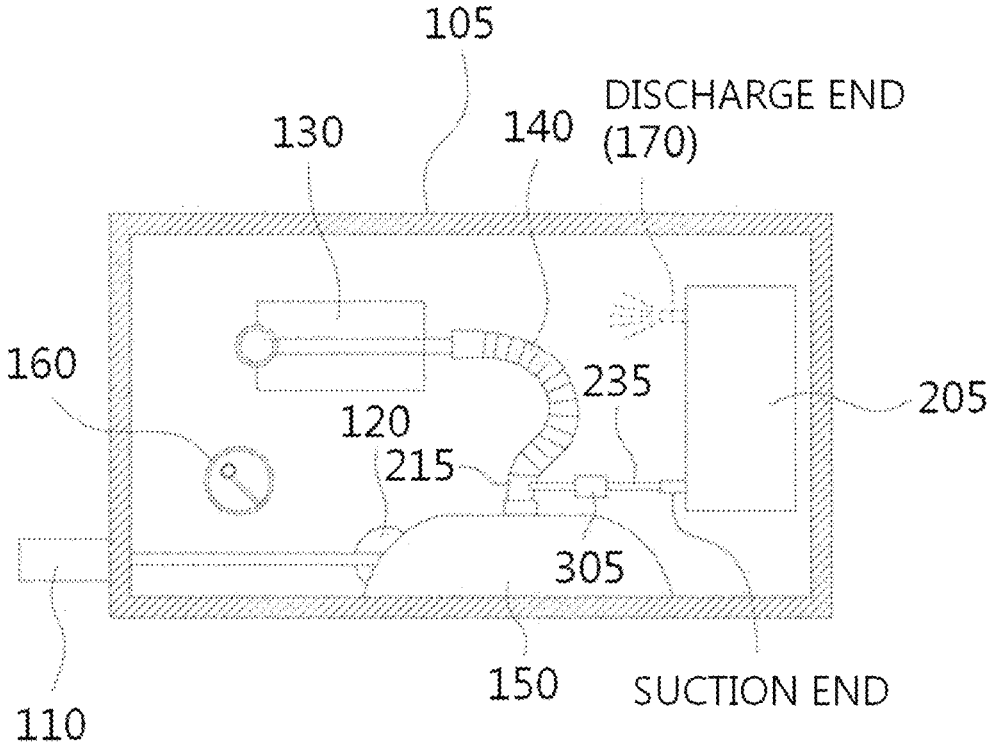
FIG. 8 is an exemplary plan view illustrating an installation example of a two way-type toilet odor removing apparatus according to the present invention.
Figure 9:
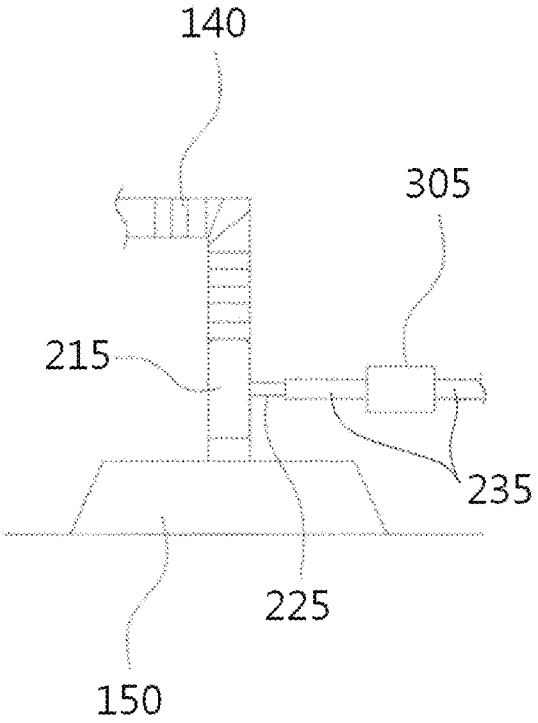
FIG. 9 is a schematic conceptual view of an extracted main portion of FIG. 8.

As illustrated in FIGS. 8 and 9, a two way-type toilet odor removing device according to the present invention includes a water tank 105 which is an example of water storing means.

The water tank 105 is a means for storing water used for discharging excrement inside a toilet body to a toilet drain port by supplying water to the toilet body formed of porcelain in a water-saving type toilet.

In particular, the present invention is applied to a toilet having a dual structure in which washing water for washing the inside of a toilet body and discharging water for discharging excrement are supplied through passages different from each other.

That is, when a lever 110 is pulled, while water is rapidly discharged inside a toilet body through a discharge port (not shown) including a water supply pipe having been closed by a flap 120, discharging water flows down to a toilet drain port together with excrement inside the toilet body.

Meanwhile, unlike the discharging water, a certain amount of washing water flows to a washing water supply pipe 140 while the flap 120 is opened, the level of stored water is lowered, and a supply valve is opened to fill a water tank which is a water storing means, and, for example, the washing water flows down through the washing water supply pipe 140 to a plurality of holes (not shown) formed on the inner circumference of the toilet body via a washing water communication chamber 150 provided in the water tank 105 and thereby washes the inner wall surface of the toilet body.

As such, the water-saving toilet reduces the amount of unnecessarily consumed washing water by allowing the washing water to be supplied through a flow passage separate from that of discharging water.

In addition, a non-described reference number "160" is an overflow pipe.

In a toilet with such a structure, the present invention is further provided with, inside a water tank 105 which is an example of water storing means, an air suctioning/discharging device 205 which is an example of a means for suctioning/discharging odor-containing air. Thus, the air suctioning/discharging device 205 quickly suctions and removes an odor to thereby prevent the odor to be spread inside a restroom, and allows a user to smell the odor from her/his excrement as little as possible.

To this end, in the present invention, a two-way distributor 215 is inserted into and fixed to the end portion of the washing water supply pipe 140.

The two-way distributor 215 is formed in an approximate "T"-shape as a direction conversion valve which causes the supply direction of a fluid to branch into two directions.

Thus, one end of the two-way distributor 215 is connected to the washing water communication chamber 150 and the other end collinear to the one end is connected to the washing water supply pipe 140, and a suctioning pipe 235 (this corresponds to the connection pipe 254 of FIG. 3) which is a connecting means is connected to a branch pipe 225 provided between the one and the other ends.

In addition, the suctioning pipe 235 is connected to a suctioning end 180 of the air suctioning/discharging device 205, and a discharging end 170 (corresponding to the discharge port 256 of FIG. 3) which is a discharging means provided to the air suctioning/discharging device 205 which is an example of air suctioning/discharging means is maintained at a state of being immersed in discharging water stored in the water tank 105.

In addition, the air suctioning/discharging device 205 is configured to suction/discharge air by means of an aspirator, and the washing water supply pipe 140 has a bellows pipe formed in a portion thereof so as to facilitate piping and may thereby be configured to be easily bent.

When configured as such, unless a user pushes the lever 110 down to flush the toilet with water, a two-way supply valve 130 always maintains a closed state. In addition, when the air suctioning/discharging device 205 automatically detects the use state of the toilet according to the operation of a sensor (not shown) and a control unit (not shown) and suctions air, the air suctioned into the air suctioning/discharging device 205 has no choice but to be suctioned from the washing water holes (formed in plurality around the inner wall surface of the toilet body) connected to the washing water communication chamber 150.

Accordingly, when the air suctioning/discharging device 205 operates, an odor inside the toilet body is quickly suctioned, is spread into water in the water tank 105 through the discharging end 170 of the air suctioning/discharging device 205, and is then removed while being dissolved into the water.

Meanwhile, in another example, the air suctioning/discharging device 205 may also suction the odor-containing air by being connected directly or via an intermediate medium to the toilet body rather than via the two-way distributor 215. In this case, the washing water supply pipe can also be connected to the washing water communication chamber directly or via a different intermediate medium rather than through the two-way distributor 215.

Since an odor of the water-saving toilet can be quickly removed only by means of such a simple structure, technical advance is actually achieved, but it is not easy due to an accompanying problem in which while the air suctioning/discharging device 205 is operated, a pulsation is generated according to suction and discharge and causes bothering noises while flowing along an earthenware which is the toilet body.

As a result of measuring the noise for a check, although there may be a difference according to the size of a space, at least a noise of 68 dB or more was measured, and this corresponds to a noise of a degree to bother a user.

Therefore, the present applicant solved the problem, through a great deal of grappling, by adopting a method of configuring a chamber so as to cancel the pulsation, and this will be described below.

That is, the pulsation itself was inevitable because the air suctioning/discharging device 205 was a kind of pump using a motor, and thus, the present applicant connected and installed a buffering chamber 305 in the middle of the length of the suctioning pipe 235 which is a connection means.

At this point, it is sufficient that the buffering chamber 305 is a closing member with various shapes having a wider space than the suctioning pipe 235, and is configured such that while a portion of the length of the suctioning pipe 235 is divided, each division is closely connected to both ends of the buffering chamber 305.

Then, even when the air suctioning/discharging device 205 is operated, a certain amount of fluid is filled in the buffering chamber 305 which has a remarkably broader space than the pipe diameter (diameter of a pipe) of the suctioning pipe 235 and thus forms a constant air flow entering a toilet washing hole by a buffering action during suctioning. Therefore, the pulsation due to pressure difference during a short time period in which suctioning and discharging are repeated is cancelled inside the buffering chamber 305, and thus, noise is remarkably reduced as much.

To check this, while the buffering chamber 305 was installed, the noise was measured by using a noise measuring device. As a result, it could be assured that the noise, which was 68 dB when the buffering chamber 305 was not provided, was reduced to an average of 59 dB.

Thus, when the present invention is used, an odor can be effectively suctioned and removed in a very short time while reducing noise also, and thus, it is expected to contribute to create a pleasant and happy toilet culture.

In addition, the operation of the air suctioning/discharging device 205 may be controlled by using a temperature sensor, or a proximity sensor for detecting an approach of a person.

The aforementioned present invention will be additionally described with reference to FIGS. 2 to 9.

As illustrated in FIGS. 3 and 4, the apparatus of the present invention is operated while including: a water storing means in which: a water supply pipe of a toilet is provided to pass through a bottom surface thereof; an upper end or an upper portion of the water supply pipe is configured to be higher than a predetermined height (for example higher than a discharge port 256 and not higher than the upper end of the water supply pipe) from the bottom surface of the storing means; a pipe for supplying water is connected to one side thereof, and which includes a water tank including an air hole formed in an upper portion thereof;

a float which is a kind of means connected to the upper portion of the water supply pipe and configured to open/close the water supply pipe and close the air hole by contacting the air hole when the water supply pipe is opened; and an air suctioning/discharging means which can be installed outside but generally installed inside the water tank, and includes a suction port connected directly or via a medium to the water supply pipe and a discharge port configured to discharge odor-containing air supplied from the suction port, wherein the discharge port is disposed at a position lower than the predetermined height (for example, the upper end portion of the water supply pipe) at which the water supply pipe is disposed, discharges air while being immersed into water, and is operated according to operations of a detection means, such as a sensor, and a control unit.

In addition, the present invention includes: a toilet body that can be used for defecation; a water controlling means including a valve body operated by a user command means including a lever type, push type, or the like; and a water storing means provided between the toilet body and the water controlling means and including a water tank which is connected to the water controlling means to receive water and is connected to the toilet body to supply discharging water, wherein: a water supply pipe, which is provided to pass through one side (for example, a bottom surface) of the water storing means, has a lower portion or a lower side in which the toilet body is provided, has an upper portion to which one side of a float operated by the water supplied to the water storing means is connected, and supplies the discharging water to the toilet body according to an operation of the float, is provided in the water storing means; an air suctioning/discharging means which is directly or indirectly connected to the water supply pipe via a medium; the air suctioning/discharging means is provided with a discharge port which discharges odor-containing air to the water storing means; and the odor-containing air suctioned from toile body through the water supply pipe is discharged, through the discharge port, to the water storing means filled with water (in general filled with water to a level not lower than the height of the float) according to the position of the float.

In addition, the present invention further includes: an air suctioning/discharging means operated in a state (a state of being immersed in water) in which a discharging means for discharging an odor is immersed in the water storing means;

a device for supplying washing water for washing the toilet to a plurality of washing water holes provided in the circumference of the toilet body; and a suctioning pipe having one end connected to the device or the toilet body and the other end connected to the air suctioning/discharging means.

A buffering chamber having a greater area than the suctioning pipe or having diameter greater than the suctioning pipe is installed in the middle of the length of the suctioning pipe to attenuate a pulsation noise caused by the air suctioning/discharging means.

So far, the technical idea of the present invention has been described with reference to the accompanying drawings, but this is for merely illustrating a preferred embodiment of the present invention rather than limiting the present invention. In addition, it is obvious that any one skilled in the art could carry out various modification and imitation without departing from the scope of the technical idea of the present invention.

In addition, as an embodiment of the present invention, an apparatus for removing an odor of a direct water-type toilet will be described, the apparatus having a simple structure to be easily installed, conveniently used, and manufactured at a low cost, and being configured to have excellent effect of removing an odor and pathogen, thereby being capable of protecting the human body and maintaining a pleasant toilet use environment.

Figure 10:
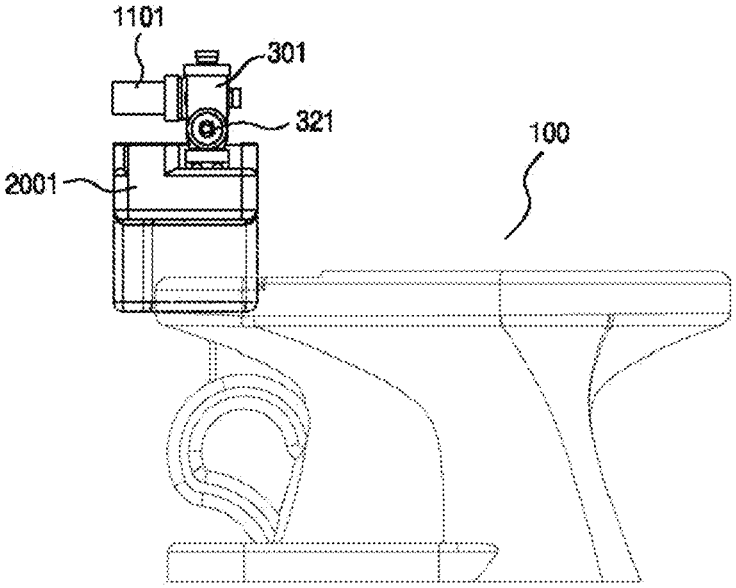
FIG. 10 is an exemplary side view of a direct water-type toilet provided with an odor removing apparatus according to the present invention.
Figure 11:
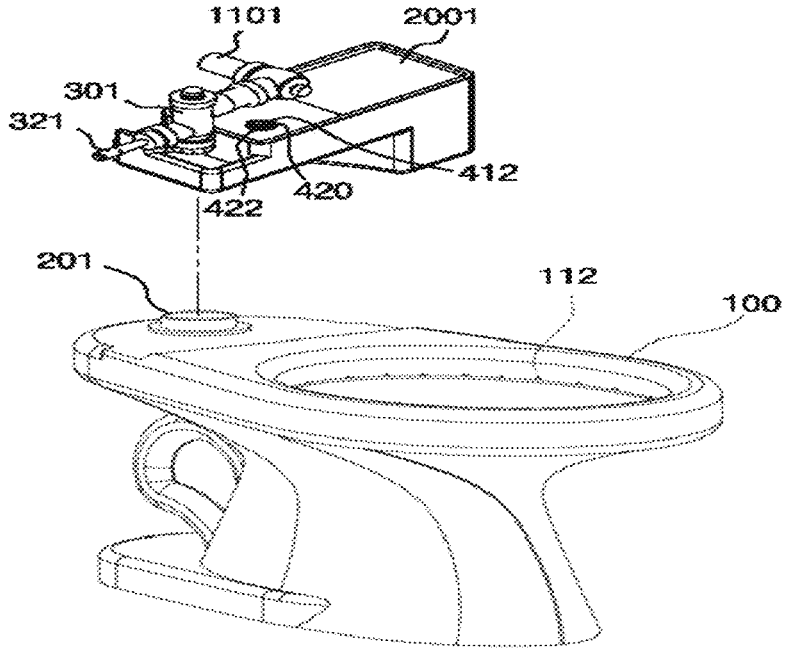
FIG. 11 is an exemplary exploded view illustrating an installation example of an odor removing apparatus according to the present invention.
Figure 12:
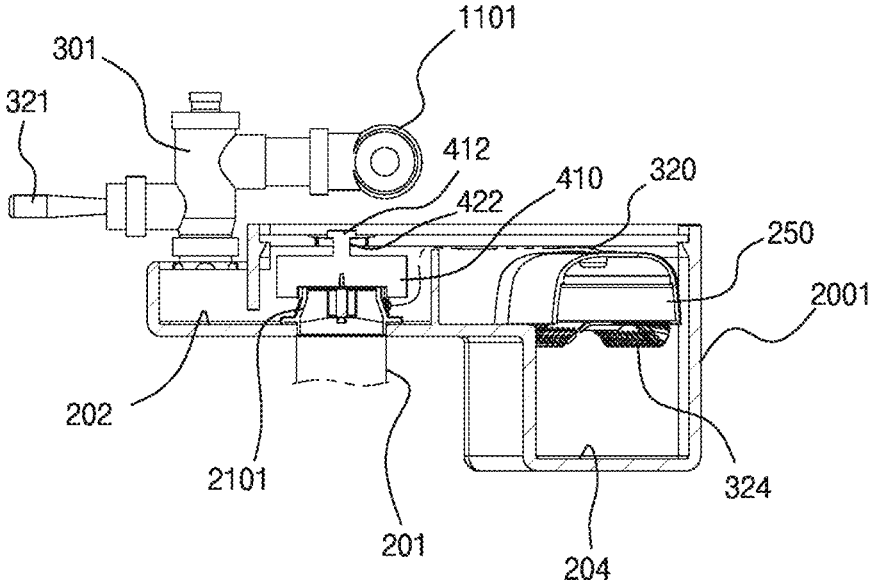
FIG. 12 is an exemplary view of a configuration of an odor removing apparatus according to the present invention.
Figure 13:
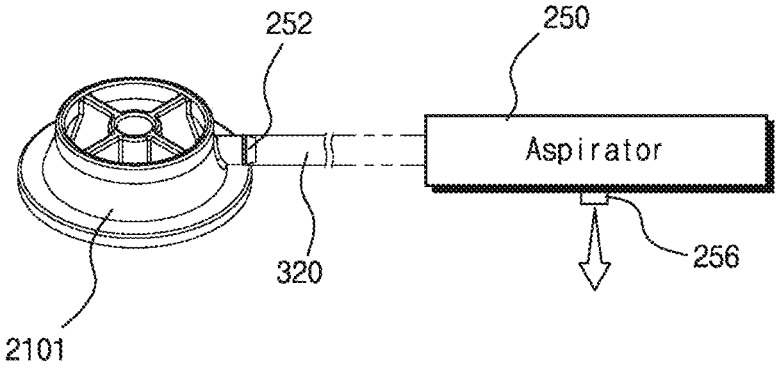
FIG. 13 is an exemplary view illustrating a connector and air suctioning/discharging means provided to an odor removing apparatus according to the present invention.

FIG. 10 an exemplary side view of a direct water-type toilet provided with an odor removing apparatus according to the present invention, FIG. 11 is an exemplary exploded view illustrating an installation example of an odor removing apparatus according to the present invention, FIG. 12 exemplary view of a configuration of an odor removing apparatus according to the present invention, and FIG. 13 is an exemplary view illustrating a connector and air suctioning/discharging means provided to an odor removing apparatus according to the present invention.

Figure 14:
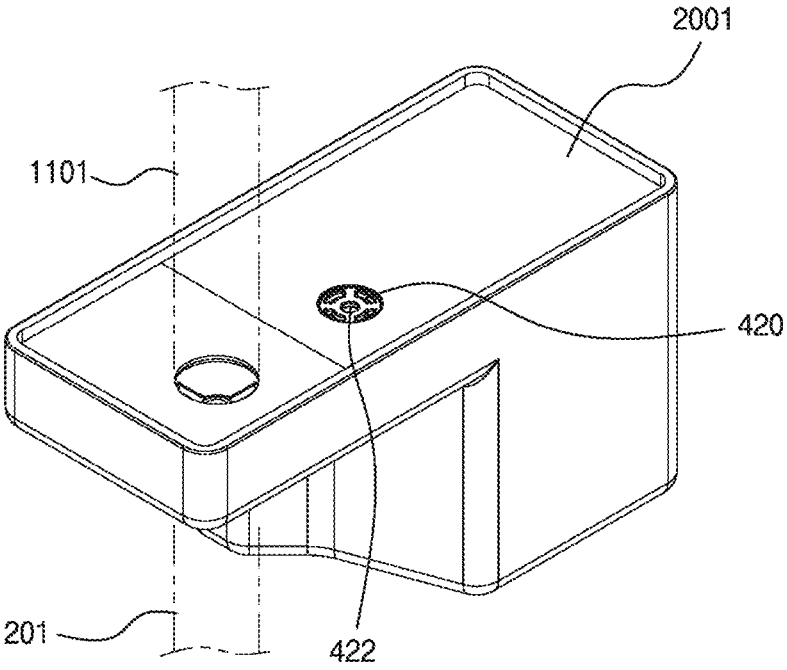
FIG. 14 is an exemplary view illustrating another example of an odor removing apparatus according to the present invention.
Figure 15:
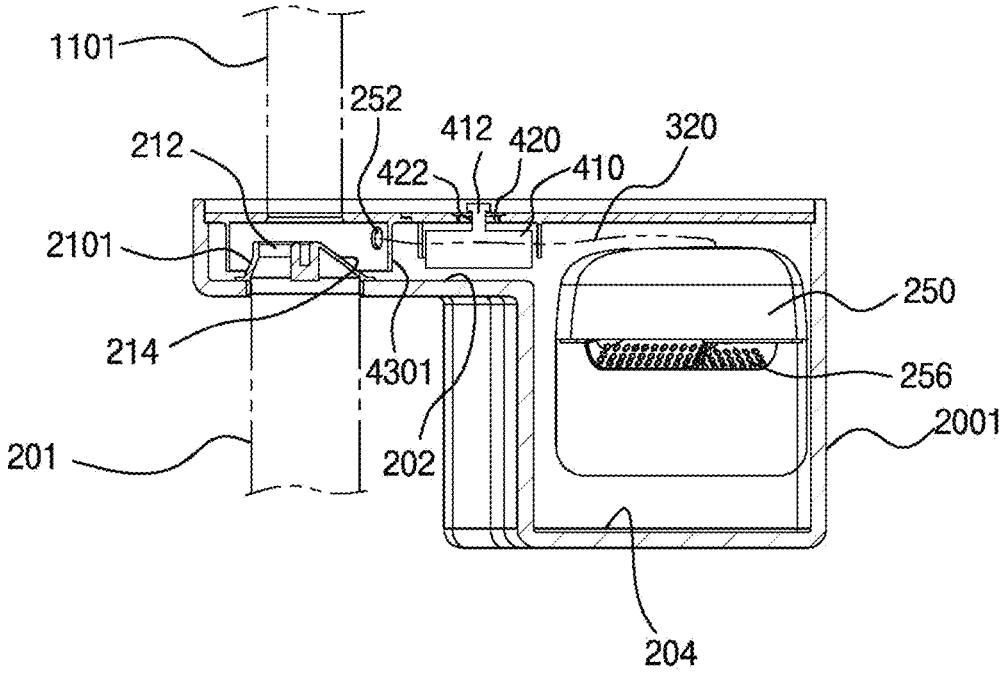
FIG. 15 is an exemplary view illustrating a configuration of another example of an odor removing apparatus according to the present invention.
Figure 16:
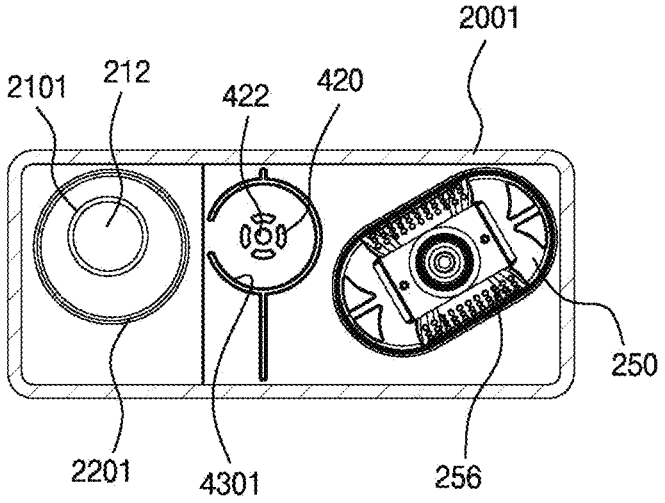
FIG. 16 is an exemplary view illustrating positions of respective means installed inside another example of an odor removing apparatus according to the present invention.
Figure 17:
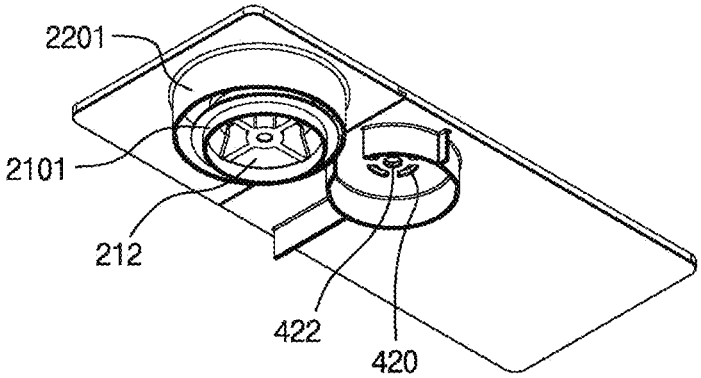
FIG. 17 is an exemplary view illustrating a configuration of another example of an odor removing apparatus according to the present invention.
Figure 18:
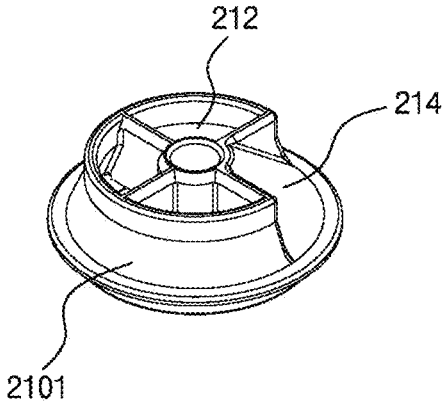
FIG. 18 is an exemplary view illustrating a connector of another example of an odor removing apparatus according to the present invention.

In addition, FIG. 14 is an exemplary view illustrating another example of an odor removing apparatus according to the present invention, FIG. 15 is an exemplary view illustrating a configuration of another example of an odor removing apparatus according to the present invention, FIG. 16 is an exemplary view illustrating positions of respective means installed inside another example of an odor removing apparatus according to the present invention, FIG. 17 is an exemplary view illustrating a connector and air hole in another example of an odor removing apparatus according to the present invention; and FIG. 18 is an exemplary view illustrating a connector of another example of an odor removing apparatus according to the present invention.

As illustrated in these drawings, the present invention favorably includes a toilet body 100.

The toilet body 100 has a commonly known structure as it is and is configured to store a predetermined amount of water and then discharge the remaining excrement to a drain after a user uses the toilet.

In addition, the present invention is favorably provided with a water tank 2001.

The water tank 2001 is favorably provided in a small size. That is, the water tank 2001 for removal of an odor differs from existing water tanks in having a relatively much smaller size than the existing water tanks and uses direct water.

Therefore, the water tank has only to be understood as having almost no restriction in installing space, and as a type including a deodorization module for suctioning an odor while water passes thereby. Furthermore, since an air hole 420 is blocked by an action of a float 410 which is an example of a water tank inner pressure adjusting means, the method is a type in which water pressure of tap water is used, and thus, the present invention may also be said to be a direct water type in which water pressure of tap water is used.

However, the present invention is obviously a novel invention in that the above-mentioned direct water-type is not a type in which portions of two components are simply merged, but a type improved such that direct water can be used. This will be sufficiently clarified by the description to be provided later.

A valve body 301, which is a kind of a means which is connected to a direct water pipe (tap water pipe) to control opening/closing water, is connected through piping to the water tank 2001, and a lever 321 which is a kind of user command input means is installed on the valve body.

In the present invention, the lever may also be replaced by a push-type device or other-type devices and the lever is an example of user command input means for opening/closing a valve. In addition, the valve body is just an example of a control means for opening/closing water and may be replaced by other unit, and thus, the scope of the present invention is not limited to the above configuration.

Accordingly, when the lever 321 is pushed, water is supplied while water pressure of the direct water pipe is applied as it is, and the water is discharged to the toilet body 100 through a connector 2101 and a water supply pipe 201. That is, since excrement is discharged due to the water pressure, the embodiment of the present invention also belongs to a direct-water type.

In the present invention, a tap water pipe 1101 contacting the valve body 301 is connected to one upper side of the water tank 2001, a connector 2101 is provided so that the water supply pipe 201 of the toilet is connected to a lower portion thereof, and the water supply pipe 201 is connected from under the water tank 2001 through piping to the connector 2101 so as to communicate with the connector 2101.

At this point, the connector 2101 provided inside the water tank 2001 should be configured such that the upper end or the upper portion thereof has a predetermined height from the bottom surface of the water tank.

To this end, it is desirable that the bottom surface of the water tank 2001 be configured from an upper-side bottom surface 202 and a lower-side bottom surface 204 so that one portion and the other portion have different heights. That is it is desirable that the upper-side bottom surface 202 and the lower-side bottom surface 204 be formed to have different heights, and the connector 2101 is provided so that the upper end of the water supply pipe 201 is connected to the upper-side bottom surface 202.

In addition, the lower-side bottom surface 204 is provided so that the air suctioning/discharging means is disposed, and the depth of the lower-side bottom surface 204 may only be a degree such that a discharge port 256 is immersed in water.

This is an idea completely different from existing water tank-type toilet, and the present invention has a structure in which the bottom of the small water tank 2001 should be filled with water at a certain height. Since in conventional water tank-type toilet, a sufficient water pressure may be obtained if water should be completely or substantially completely discharged rather than remain in the bottom of the water tank.

On the contrary, in the present invention, water is discharged due to the water pressure of tap water, and the inner structure of the water tank is modified such that the inlet of the water supply pipe is positioned at a predetermined height to allow water to be present under the inlet. Thus, the water may be used to dissolve an odor supplied through the discharge port 256 which is an example of a discharging means provided to an aspirator which is an example of sir suctioning/discharging means.

Meanwhile, inside the water tank 2001, an aspirator 250 which is one of the air suctioning/discharging means is installed.

The aspirator 250 is a general collective name of units which can suction a kind of air, and the aspirator 250 suctions an odor remaining inside the toilet body 100 through connector 2101, to which the water supply pipe 201 is connected, and allows the air to be dissolved in the water stored at a predetermined height from the bottom of the water tank 2001.

Accordingly, in the aspirator unit, a portion of internal air in which an odor is dissolved and purified is allowed to be discharged to the outside in a purified state through an air hole 420.

Therefore, the air hole 420 is a very important configuration. The inner pressure of the water tank 2001 varies according to the operation of the aspirator 250 which is an air suctioning/discharging means (for example, when the inner pressure increases, a gas mixture containing an odor is not suctioned), and the varying inner pressure may maintain an equilibrium while being naturally discharged through the air hole 420.

To this end, the present invention is favorably provided with a water tank inner pressure adjusting means which maintains a constant inner pressure, and the water tank inner pressure adjusting means favorably include a float 410. Here, maintaining a constant inner pressure is also an example of water tank inner pressure adjusting means.

In addition, the air hole 420 through which external air may be introduced to mitigate an inner pressure of the small water tank 2001 is formed on an upper surface of the small water tank 200.

The float 410 operates to close the air hole 420, that is, the float 410 closes the air hole 420 when the lever 321 is pushed, so that water may be supplied, while the water pressure of tap water is applied as it discharged to the toilet body 100 through the connector 2101 and the water supply pipe 201 inside the water tank 2001.

In addition, the air suctioning/discharging means is provided with a suction port 252 and a discharge port 256, the suction port 252 has a hole formed in one portion or one portion of the circumferential edge of the connector 2101 provided inside the water tank 2001 or a portion, and the suctioning port 252 is configured by being connected to the hole through a suction pipe 320 which is a connecting means.

In addition, a plurality of discharge ports 256 are formed in a lower side surface, including a lower end, of the aspirator 250 to discharge the suctioned odor to the water tank 2001, and the discharge ports 256 should always be in a state of being immersed in water.

The reason why this is possible is, as described above, because the discharge ports 256 are located on the lower-side bottom surface 204, which is formed in the water tank 2001 so as to form a height difference in the bottom surface, and water is always filled up to a height equal to or smaller than that of the connector 2101.

In addition, in the operation of the aspirator 250, as an example of the operation, a temperature sensor for detecting the body temperature of a person, a proximity sensor for detecting an approach of a person, or a sensor for detecting an odor (for example, a kind of odor sensor for detecting a specific odor such that the sensor detects the odor when a component content emitting the specific odor reaches a certain degree) is installed on a portion of the toilet body 100, and the aspirator 250 may be configured to be turned on/off according to the control of the control unit (not shown) by using the detected signal of the sensor.

As another example, when the lever 321 is operated, or also when the toilet is flushed with water after being used, a circuit design can be made, of course, so as to operate for a predetermined time after the float 410 is closed. The closure of the float may be confirmed from another sensor, or may be set such that when a predetermined time elapses after the float is opened, the float is closed.

The present invention including such a configuration has an operation relationship as the following.

When a user sits on the toilet body 100 to relieve herself/himself and starts to relieve, the aspirator 250 is operated. That is, the aspirator 250 can be operated by one or more operations of any one or more of the sensors and according to a control of the control unit.

Then, an odor is suctioned through a water supply port or a washing water holes 112 which are formed in the inner wall surface of the toilet body 100, and the suctioned odor is collected into the water supply pipe 201, and is then discharged into the water stored in the small water tank 2001 through the discharge ports 256 via the aspirator 250 through the connector 2101.

Accordingly, the odor is discharged into the water in a bubble shape, and is therefore instantaneously dissolved, and an increased pressure generated in this process inside the small water tank 2001 is released through the air hole 420.

Subsequently, when the relieving is completed and the toilet is flushed with water by pushing down the lever 321, direct water from a tap water pipe is instantaneously introduced into the water tank 2001, and the float 410 is raised simultaneously. When the water level exceeds the upper end of the connector 2101, excrement is discharged to a drain tank by discharge water while water is rapidly discharged through the connector 2101 and the water supply pipe 201.

In this process, if the water level rises too high, the upper portion or the upper end portion of the rising float 410 closes the air hole 420, while contacting the upper surface of the water tank 2001, thereby seals the air hole 420 such that water may not be scattered to the outside through the air hole 240, and thus the toilet can be safely used. In this case, water may be more strongly discharged through the water supply pipe.

In addition, when the toilet is flushed with water, the operation of the aspirator 250 is in a state of being stopped or being performed. That is, the operation may be turned on/off according to the preset information, the sensing information, or the information which is about a user, who is the person using the toilet, and is manually input.

As such, a direct-water type is also implemented in a hybrid type by incorporating the water tank 2001, and thus, may be expected to be very useful in sanitary and health aspects because an odor can be effectively and efficiently suctioned and removed.

The above-described embodiments of the present invention will be additionally described with reference to FIGS. 10 to 18.

An embodiment of the present invention is favorably provided with a water storage means.

The water storage means is provided with a water tank 2001, and a tap water pipe 1101 connected to a valve body 301 is connected to one side of an upper portion of the water tank 2001.

In addition, a connector 2101 is installed inside the water tank 2001 so that a water supply pipe 201 of the toilet is connected to a lower portion of the water tank 2001.

At this point, the upper end or upper portion of the connector 2101 is configured to have a predetermined height from the bottom surface of the water tank 2001, so that the water supplied from the tap water pipe 1101 is discharged to the water supply pipe 201 through the connector 2101, and a portion of the discharge water is stored in the water tank 2001.

An embodiment of the present invention is favorably provided with an air suctioning/discharging means.

The air suctioning/discharging means is installed inside the water tank 2001 and includes a suction port 252 connected to the connector 2101 and a discharge port 256 which discharges air containing odor supplied from the suctioning port 252.

Here, the discharge port 256 discharges air in a state of being immersed in the water stored in the water tank.

This air suctioning/discharging means is favorably operated by the operation of a detecting means and a control unit.

An embodiment of the present invention is favorably provided with a water tank inner pressure adjusting means.

The water tank inner pressure adjusting means has an air hole 420 on the upper portion of the water tank so that the inner pressure of the water tank 2001 is maintained at a constant pressure even during the operation of the air suctioning/discharging means so as to allow approximate equilibrium with the atmospheric pressure, and includes a float 410 which closes the air hole 420 by contacting the air hole 420 due to the level of water stored in the water tank.

Another embodiment of the present invention is favorably provided with a toilet body 100 and a water controlling means for controlling water so that the toilet body 100 can be washed.

The water controlling means includes a valve body 301 which is operated to supply water through a tap water pipe 1101 such that the toilet body 100 is washed by the operation of a user command means including a lever 321 or a sensing means.

Another embodiment of the present invention is favorably provided with a water storage means.

The water storage means includes the water tank 2001 which is provided between the water controlling means and the toilet boy and can store a portion of water supplied through the tap water pipe 1101.

Another embodiment of the present invention is favorably provided with a water discharge means.

The water discharge means includes a connector 2101 formed in the water tank 2001 and connected to the water supply pipe 201 of the toilet and is configured such that the upper end or the upper portion of the connector 2101 has a height from the bottom surface of the water tank, thereby discharging water to the toilet body 100 through the connector 2101 and the water supply pipe 201 while storing a portion of water supplied through the tap water pipe 1101.

Also, in another embodiment of the present invention, the air suctioning/discharging means and the water tank inner pressure adjusting means are favorably provided.

Such the air suctioning/discharging means and the water tank inner pressure adjusting means have the same configurations as the technical features described in the above embodiment, and detailed descriptions thereof will not be provided to avoid overlapping description.

Meanwhile, in the above embodiments, the connector 2101 may be installed in the water tank so as to be disposed at a position spaced apart from the installation position of the tap water pipe 1101 connected to the water tank 2001.

Here, the float is favorably installed above the connector 2101 and the air hole 420 should be formed at a position closed by the float 410.

The reason why the connector 2101 and the tap water pipe 1101 are disposed at positions spaced apart from each other as described above is because the position of the tap water pipe installed in the water tank of the present invention can be changed, and this may be briefly described as follows: existing water supply pipe 201 is connected, as it is, to the lower portion of the connector 2101; the installation position of the tap water pipe 1101 may be changed; and in this case, an extension pipe (not shown) may be installed on the tap water pipe by the amount according to a changed position of the tap water.

In addition, in the above embodiments, the connector 2101 may be disposed collinearly with the tap water pipe 1101 so as to be positioned directly under the tap water pipe 1101 connected to the water tank 2001. This has a merit in that the tap water pipe and water supply pipe which are installed in an existing toilet can be installed as it is without positional changes thereof.

In this case, a vertically passing-through water supply path 212 may be formed in the connector 2101 such that the water supplied through the tap water pipe 1101 can be directly supplied and discharged to the water supply pipe 201, a water branch path 214, which causes water stream to branch such that a portion of the supplied water is stored in the water tank, may be formed, and this water tank has a merit in that water pressure can be raised.

Meanwhile, in the above embodiments, the suction port 252 of the air suctioning-discharging means and the air hole 420 of the water tank inner pressure adjusting means are favorably disposed in spaces separated from each other, and to this end, a partitioning wall 2201 which partitions the inside of the water tank 2001 is favorably formed.

Here, the partitioning wall 2201 is formed to protrude from the upper surface of the water tank 2001 and formed such that the lower end of the partitioning wall 2201 is separated from the bottom surface of the water tank 2001, that is, a predetermined space is formed between the lower end or the partitioning wall and the bottom surface of the water tank, and water fills the separated space, and thus, the inner space of the water tank may be separated.

In addition, in the above embodiments, the bottom surface of the water tank 2001, as already described above, is favorably configured from the upper-side bottom surface 202 and the lower-side bottom surface 204 so as to one and the other portion thereof has different heights, the upper-side bottom surface 202 favorably has the connector 2101 formed thereon, and the lower-side bottom surface 204 is favorably installed to have the air suctioning/discharging means.

Meanwhile, in the above embodiments, a guide hole 422 is formed in the central portion of the air hole 420, a guide rod 412 is formed to protrude upward from the float 410 so as to be guided by the guide hole 422, and thus, the water tank inner pressure adjusting means is favorably configured to operate such that the guide rod is guided by the guide hole 422.

In addition, the water tank inner pressure adjusting means favorably has a guide wall part 4301 which is disposed close to the float 410, has a size corresponding to the float 410, and has an open side, so that the float 410 is disposed inside the guide wall part 4301.

The guide wall part 4301 is provided to ensure the operation of the float 410 to be precisely performed.

In addition, in the above embodiments, the aspirator 250 may be provided as an air suctioning/discharging means, and the aspirator 250 favorably includes the suctioning pipe 320 which has an end connected to the connector 2101 and the other end connected to the aspirator so that air containing odor of the toilet body 100 is suctioned through the water supply pipe 201 and the connector 2101 while water is not supplied to the toilet body 100, and the suctioned air is discharged while being immersed in the water stored in the water tank.

Meanwhile, an air bubble generator used for a fish bowl which is not immersed in water may be provided as the air suctioning/discharging means. The air bubble generator favorably includes: an air bubble generator main body which can suction air containing odor of the toilet body 100 through the water supply pipe and the connector while water is not supplied to the toilet body 100, and discharge the suctioned air through the discharge port, the air bubble generator main body being installed at a position which is not immersed in water; and a suctioning pipe which has an end connected to the connector 2101 and the other end connected to the aspirator so that discharge port discharges the suctioned air while being immersed in the water. In still another embodiment of the present invention, provided are: a water supplying means which supplies water such that washing water for washing a toilet is discharged through a plurality of washing water holes formed in inner periphery of a toilet body; and a water tank which stores a portion of the water supplied by the water supply means, wherein an aspirator provided with: a suctioning means for suctioning odor-containing air; and a discharging means for discharging the air suctioned by the suctioning means while the air immersed in the water stored in the water tank; an air hole is formed on an upper portion of the water tank so that the inner pressure of the water tank is maintained at a constant pressure during the operation of the aspirator to allow approximate equilibrium with the atmospheric pressure; and a float which closes the air hole by being brought into contact with the air hole due to the level of the water stored in the water tank is installed.

Embodiments of the present invention may be applied to all devices, facility, structures such as a restroom in which a toilet is used.

Thus, according to the present invention, an excellent effect of removing an odor is also exhibited particularly in a direct water-type toilet, so that growth of bacteria and odors is prevented, pathogens are prevented from being spread to the entire rest room to thereby provides a more pleasant toilet use environment, and the apparatus for removing an odor has simple structure and is easy and convenient to install and may thereby be manufactured at a low cost.

INDUSTRIAL APPLICABILITY

The present invention may be applied to all devices, facility, structures such as a restroom in which a toilet is used.

The invention claimed is:

1. An apparatus for removing a bad odor from a toilet, comprising:

a water storing means comprising a water tank, in which:

a water supply pipe of a toilet is provided to pass therethrough;

an upper end or an upper portion of the water supply pipe is provided to be at a predetermined height from a bottom surface thereof;

a tap water pipe connected to a valve body is connected to one side thereof; and an air hole is formed in an upper portion thereof;

a float which is connected to the upper portion of the water supply pipe and configured to open/close the water supply pipe and close the air hole by contacting the air hole when the water supply pipe is opened; and an air suctioning/discharging means which is installed inside the water tank and comprises a suction port connected to the water supply pipe, and a discharge port which discharges odor-containing air supplied from the suction port, wherein the discharge port is disposed at a position lower than the predetermined height at which the water supply pipe is disposed, discharges air while being immersed into water, and is operated according to operations of a detection means and a control means.

2. The apparatus of claim 1, wherein one side of the water supply pipe and a suction port of an aspirator, which is a kind of the air suctioning/discharging means, are connected by means of a connection pipe, and an odor is suctioned according to an operation of the aspirator.

3. The apparatus of claim 1, wherein an air vent hole vertically passing through the float is formed in the float at a position corresponding to the air hole formed in the water storing means including the water tank, and a valve (CK1) communicating with the air hole while being opened when contacting the air hole is installed on an upper end of the air vent hole.

4. The apparatus of claim 3, wherein the valve (CK1) comprises:

a fixed base inserted into and fixed to the upper end of the air vent hole;

a flow hole formed to pass through the fixed base;

a movable rod inserted into the flow hole;

a sealing plate fixed to the lower end of the movable rod;

a cylindrical cap detachably fixed to the fixed base;

an air outlet hole perforated in a portion of the circumference of the cap; and an elastic spring interposed between the inner bottom surface of the cap and the lower surface of the sealing plate.

5. The apparatus of claim 3, wherein the air hole comprises a contact plate, and an upper end of the movable rod of the valve CK1 is pressed while contacting the contact plate and the air hole is thereby opened, and thus, air is introduced into the air vent hole via the flow hole and the air outlet hole.

6. An apparatus for removing a bad odor from a toilet, comprising:

a toilet body;

a water controlling means comprising a valve body operated by a user command means including a lever; and a water storing means provided between the toilet body and the water controlling means and comprising a water tank which is connected to the water controlling means to receive water and is connected to the toilet body to supply discharging water, wherein:

a water supply pipe is provided in the water storing means, is provided to pass through one side of the water storing means, has a lower portion or a lower side to which the toilet body is connected, has an upper portion, to which one side of a water level adjusting means including a float operated by the water supplied to the water storing means is connected, and supplies the discharging water to the toilet body according to an operation of the float;

an air suctioning/discharging means is provided to be connected to the water supply pipe;

the air suctioning/discharging means comprises a discharge port which discharges odor-containing air to the water storing means; and the odor-containing air suctioned from the toilet body through the water supply pipe is discharged, through the discharge port immersed in the water, to the water storing means.

7. The apparatus of claim 6, wherein an air hole is provided on one side of the water storing means, and the air hole is provided in a position at which the air hole is opened/closed according to an operation of the float.

8. An apparatus for removing a bad odor from a toilet, comprising:

a toilet body;

a water controlling unit comprising a valve body operated to supply water through a tap water pipe to wash the toilet body by a user command unit including a lever or by a sensing means;

a water storing means provided between the toilet body and the water controlling unit and comprising a water tank configured to store a portion of water supplied through the tap water pipe to wash the toilet body;

a water discharge means comprising a connector formed in the water tank and connected to the water supply pipe of the toilet and is configured such that an upper end or an upper portion of the connector has a height from a bottom surface of the water tank, thereby discharging water to the toilet body through the connector and the water supply pipe while storing a portion of water supplied through the tap water pipe;

an air suctioning/discharging means comprising a suctioning port connected to the connector of the water discharging means, and a discharge port configured to discharge air containing odor supplied from the suctioning port, wherein the discharge port discharges the air while being immersed in the water and is operated according to an operation of a sensing means and a control unit; and a water tank inner pressure adjusting means comprising an air hole on an upper portion of the water tank so that a constant inner pressure of the water tank is maintained to allow approximate equilibrium with an atmospheric pressure, and a float brought into contact with the air hole due to a level of water stored in the water tank to thereby close the air hole.

9. The apparatus of claim 8, wherein the connector is disposed collinearly with the tap water pipe so as to be positioned directly under the tap water pipe connected to the water tank, and comprises:

a vertically passing-through water supply path formed in the connector such that the water supplied through the tap water pipe is directly supplied and discharged to the water supply pipe; and a water branch path formed in the connector to cause water stream to branch such that a portion of the supplied water is stored in the water tank.

10. The apparatus of claim 8, comprising a partitioning wall which partitions an inside of the water tank such that the suction port of the air suctioning-discharging means and the air hole of the water tank inner pressure adjusting means are disposed in spaces separated from each other, wherein the partitioning wall is formed to protrude from an upper surface of the water tank and formed such that a lower end of the partitioning wall is separated from the bottom surface of the water tank, and an inner space of the water tank is divided by filing the separated portion with water.

11. The apparatus of claim 8, comprising an aspirator as the air suctioning/discharging means, wherein the aspirator comprising a suctioning pipe which has an end connected to the connector, and another end connected to the aspirator, so that air containing odor of the toilet body is suctioned through the water supply pipe and the connector while water is not supplied to the toilet body, and the suctioned air is discharged while being immersed in the water stored in the water tank.

12. The apparatus of claim 8, comprising an air bubble generator which is provided as the air suctioning/discharging means and comprises:

an air bubble generator main body which suctions air containing odor of the toilet body through the water supply pipe and the connector while water is not supplied to the toilet body, and discharges the suctioned air through the discharge port, wherein the air bubble generator main body is installed at a position which is not immersed in water; and a suctioning pipe which has an end connected to the connector and another end connected to the air bubble generator main body so that the discharge port discharges the suctioned air while being immersed in the water stored in the water tank.

* * * * *